US008373102B2

(12) United States Patent
Sakakibara et al.

(10) Patent No.: US 8,373,102 B2
(45) Date of Patent: Feb. 12, 2013

(54) INDUCTION COOKER

(75) Inventors: Kuniaki Sakakibara, Hyogo (JP); Keiko Isoda, Hyogo (JP); Masamichi Komada, Hyogo (JP); Hiroshi Tominaga, Hyogo (JP); Fumitaka Ogasawara, Hyogo (JP)

(73) Assignee: Panasonic Corporation, Osaka (JP)

( * ) Notice: Subject to any disclaimer, the term of this patent is extended or adjusted under 35 U.S.C. 154(b) by 564 days.

(21) Appl. No.: 12/666,056

(22) PCT Filed: Jun. 9, 2008

(86) PCT No.: PCT/JP2008/001454

§ 371 (c)(1),
(2), (4) Date: Dec. 22, 2009

(87) PCT Pub. No.: WO2009/001513

PCT Pub. Date: Dec. 31, 2008

(65) Prior Publication Data

US 2010/0181303 A1 Jul. 22, 2010

(30) Foreign Application Priority Data

Jun. 22, 2007 (JP) ..... 2007-164616

(51) Int. Cl.
*H05B 6/12* (2006.01)

(52) U.S. Cl. ..... 219/622; 219/620; 219/621; 219/623; 219/624; 219/625; 219/626; 219/627

(58) Field of Classification Search ..... 219/620–627
See application file for complete search history.

(56) References Cited

U.S. PATENT DOCUMENTS 4,456,807 A * 6/1984 Ogino et al. ..... 219/626

FOREIGN PATENT DOCUMENTS

JP 02-148686 A 6/1990
JP 07-180845 A 7/1995

(Continued)

OTHER PUBLICATIONS

International Search Report for International Application No. PCT/JP2008/001454, dated Sep. 16, 2008, 2 pages.

(Continued)

*Primary Examiner* — Matthew W Such
*Assistant Examiner* — Robert Carpenter
(74) *Attorney, Agent, or Firm* — Brinks Hofer Gilson & Lione

(57) ABSTRACT

An induction cooker includes a top plate (1) for placing an object to be heated thereon, a heating mode selection key (8) for allowing the user to select one control mode for heating the object to be heated between a manual heating mode in which the heat output is set by the user by using an output adjusting key (9) and at least another control mode in which the heat output is controlled automatically, and a heating off/on key (7) for starting to heat the object to be heated. In the standby mode, the controller starts heating only when the user operates the heating mode selection key (8) to change the mode to the cooking menu selection mode before operating the heating off/on key (7). When a predetermined time has elapsed in the cooking menu selection mode without a change in a selected control mode, the mode is changed to the standby mode. This prevents heating from occurring when the user inadvertently presses the heating off/on key (7) while the heating is not going on, thus providing the induction cooker with a high degree of safety and increased user-friendliness.

14 Claims, 4 Drawing Sheets

FOREIGN PATENT DOCUMENTS

| | | | |
|---|---|---|---|
| JP | 10-220777 | A | 8/1998 |
| JP | 10-246444 | A | 9/1998 |
| JP | 11-055853 | A | 2/1999 |
| JP | 11-121158 | A | 4/1999 |
| JP | 2003-109734 | A | 4/2003 |
| JP | 2003-142244 | A | 5/2003 |
| JP | 2004-350829 | A | 12/2004 |
| JP | 2005-265207 | A | 9/2005 |
| JP | 2005-265212 | A | 9/2005 |
| JP | 2006-294369 | A | 10/2006 |

OTHER PUBLICATIONS

Extended European Search Report for European Application No. 08764051.2, dated Jun. 27, 2012, 6 pages.

* cited by examiner

INDUCTION COOKER

TECHNICAL FIELD

The present invention relates to induction cookers used, for example, in domestic and industrial kitchens.

BACKGROUND ART

Induction cookers have come to be known for their advantageous features such as safety, cleanness, and high heating efficiency, and therefore have been widely used, for example, in domestic and industrial kitchens in recent years.

In some induction cookers, when the user turns on the power switch, a locked state occurs requiring the user to operate an unlock key, which is a touch key for releasing the locked state, and then to operate a heat on key for starting heating (see, for example, Patent Literatures 1 and 2 below).

Such an induction cooker has a dedicated unlock key. When the cooker includes a number of operation keys for the control mode such as a temperature control key, a water heating key, and a rice cooking key in addition to the heating start key, the user is required to perform an unlock operation every time before operating one of these operation keys, making the induction cooker user-unfriendly. Thus, it has been an urgent issue to reduce the number of operation keys so as to simplify the operation while requiring the user to perform a two-step operation before starting heating so as to ensure safety.

Patent Literature 1: Japanese Patent Unexamined Publication No. 2005-265207

Patent Literature 2: Japanese Patent Unexamined Publication No. 2005-265212

SUMMARY OF THE INVENTION

In order to solve the aforementioned issue, the present invention has an object of providing an induction cooker which has a reduced probability of starting heating when the user does not intend it so as to ensure a high degree of safety and which includes a reduced number of operation keys to have a simple structure of the operating part, thus providing user-friendliness.

The induction cooker according to the present invention includes a heating mode selection key which allows the user to select one control mode for heating an object to be heated between a manual heating mode and at least another control mode. In the manual heating mode, the heat output is set by the user by using an output adjusting key. In the at least another control mode, the heat output is controlled automatically.

The induction cooker further includes a controller, which is constructed such that heating is not started when the user operates a heating start key in a standby mode but is started in a selected control mode when the user operates the heating start key after operating the heating mode selection key to change the standby mode to a cooking menu selection mode and to select one of the control modes. The controller is further constructed such that when a predetermined time has elapsed in the cooking menu selection mode without a change in the control mode selected by the user from the control modes by operating the heating mode selection key, the mode is changed to the standby mode.

Assume that the heating coil is not in operation and the user does not have an intention to start heating such as in cases where a long time has elapsed without starting heating after the user turns on the power switch to activate the operating part, or where the power switch remains in the ON state after the user has stopped heating by operating the heating stop key. In such situations, heating is not started even if the heating start key or other key in the operating part is pressed inadvertently. The heating mode selection key functions as a release key to release this state when a predetermined time has elapsed, allowing to start heating when the heating start key is operated next time.

With the above-described structure, the induction cooker has a reduced number of operation keys and prevents heating from occurring when the user does not intend it, thereby providing a high degree of safety and increased user-friendliness.

DETAILED DESCRIPTION OF THE PREFERRED EMBODIMENTS

An embodiment of the present invention will be described as follows with reference to drawings. Note, however, that the present invention is not limited to the embodiment.

First Exemplary Embodiment

Figure 1:
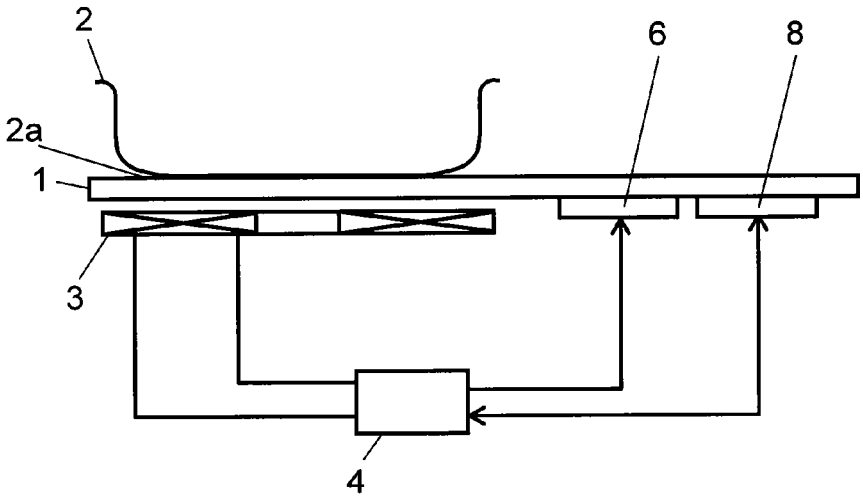
FIG. 1 is a block diagram of a sectional structure and a circuit structure of an induction cooker according to a first exemplary embodiment of the present invention.
Figure 2:
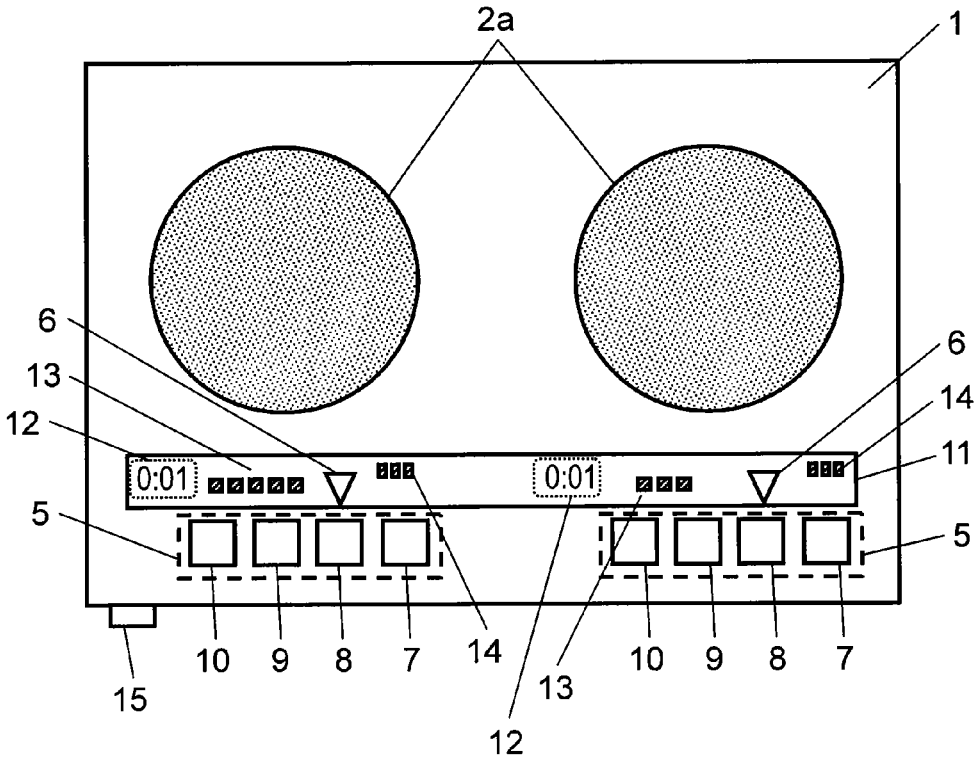
FIG. 2 is an external plan view of the top of a top plate of the induction cooker according to the first exemplary embodiment of the present invention.

FIG. 1 is a block diagram of a sectional structure and a circuit structure of an induction cooker according to a first exemplary embodiment of the present invention. FIG. 2 is an external plan view of the top of a top plate of the induction cooker.

As shown in FIGS. 1 and 2, the induction cooker of the present exemplary embodiment includes heating coils 3, top plate 1, controller 4, heating mode selection keys 8, and heating off/on keys 7. Heating coils 3 are disk-shaped and induction-heat object-to-be-heated 2 by generating a high-frequency magnetic field. Top plate 1 is placed above heating coils 3 and allows object-to-be-heated 2 to be placed thereon. Controller 4 controls the heat output of heating coils 3. Heating off/on keys 7 are pressed to start or stop the heating of object-to-be-heated 2. Heating mode selection keys 8 allow the user to select one control mode for heating object-to-be-heated 2 between a manual heating mode and at least another control mode. In the manual heating mode, the heat output is set by the user by using output adjusting keys 9, whereas in the at least another control mode, the heat output is controlled automatically. In a standby mode, controller 4 controls heating coil 3 to start heating object-to-be-heated 2 only when the user operates heating off/on key 7 as a heating start key within a predetermined time after operating heating mode selection key 8 to select one of the control modes. When the user operates heating mode selection key 8 in the standby mode, the mode is changed to a cooking menu selection mode, and when a predetermined time has elapsed in the cooking menu selection mode without a change in the selected control mode, the mode is changed to the standby mode.

This prevents heating from occurring when the user inadvertently presses heating off/on key 7 as the heating start key in the operating part while heating coil 3 is not in operation in spite that the user does not have an intention to start heating. Such situations occur, for example, when a predetermined time, like one minute, has elapsed without heating being started after the user turns on power switch 15 to activate touch key groups 5 as the operating part, or when the user has stopped heating by operating heating off/on key 7 as the heating stop key in touch key group 5. Heating mode selection keys 8 each functioning as a release key to release the standby mode make it unnecessary to provide a release key to release the standby mode in which heating is not started even if the user operates heating off/on key 7. Furthermore, heating mode selection keys 8 are always operated first in order to select a control mode, providing the user with an operation that is simple and easy to remember. Thus, the induction cooker of the present exemplary embodiment has a reduced number of operation keys to simplify the operation and prevents heating from occurring when the user does not intend it, thereby providing a high degree of safety and increased user-friendliness.

The components of the induction cooker according to the present exemplary embodiment will be described as follows with reference to FIGS. 1 and 2. Top plate 1 is made of heat resistant material such as crystallized ceramics, and has heating area symbols 2*a* printed on either the front or rear surface thereof so as to indicate the position to place object-to-be-heated 2 such as pan 2. Heating coils 3 are disposed under top plate 1 so as to be opposite to heating area symbols 2*a*, thereby induction-heating the bottom surface of pan 2 by generating a high-frequency current. The amplitude of the high-frequency current flowing through heating coils 3 is controlled by controller 4 including an inverter, thereby controlling the heat output to heat pan 2. Top plate 1 is further provided on either the front or rear surface thereof with a plurality of electrodes forming touch key groups 5. Controller 4 applies a high-frequency voltage to the electrodes forming the touch keys of touch key groups 5, and measures their output voltages so as to detect which touch key the user has pressed. In other words, touch key groups 5 consist of capacitive touch keys, and which key the user has pressed is recognized by detecting a change in the capacitance of the electrodes with respect to the ground. These electrodes may be formed by printing a conductive thin film on top plate 1 or by pressing electrodes against the rear surface of top plate 1. Touch key groups 5 include heating mode selection keys 8.

The induction cooker also includes selection key indicator lamps 6 in the vicinity on the heating coils 3 side of heating mode selection keys 8. Selection key indicator lamp 6 each indicate the position of heating mode selection key 8 when it lights up, and becomes invisible when it goes out. In the present exemplary embodiment, the induction cooker also includes belt-shaped or frame-like black partition part 11 on the rear surface of transparent top plate 1. Partition part 11 is formed by forming a light non-transmissive print film including a blank portion, and then printing a light-transmissive black layer (not shown) of black or dark brown on the blank portion. Selection key indicator lamps 6 can each be formed of a light shielding layer, a blank portion, and a LED (not illustrated). The light shielding layer, which is light non-transmissive or has a low light transmittance, is formed on the surface of the light-transmissive black layer in partition part 11. The blank portion is formed by removing part of the light shielding layer. The LED is disposed under the blank portion and emits, for example, red light. When the LED is turned on, selection key indicator lamp 6 which is an index mark in the form of an inverted triangle is illuminated by the LED so as to light up in red in the blank portion of the light shielding layer and recognized by the user. The turning on and off of the LED of selection key indicator lamp 6 is controlled by controller 4.

The induction cooker includes top plate 1 at its top surface, and as shown in FIG. 2, includes heating area symbols 2*a* on which pans 2 can be placed. Capacitive touch key groups 5 formed by printing electrodes at least on the front or rear surface of top plate 1 are disposed closer to the front than partition part 11 including the display parts, so that the user can easily operate the touch keys.

Touch key groups 5 each include heating off/on key 7 for starting and stopping heating, heating mode selection key 8 for selecting one of the control modes, output adjusting key 9 for adjusting the heat output in the manual heating mode, and timer key 10 for setting timer time. Heating off/on key 7 is pressed to start heating under predetermined conditions while the heating is not going on, and to stop heating unconditionally while the heating is going on.

Each output adjusting key 9 may be formed of either a single touch key or a plurality of touch keys. In the former case, the heat output is increased or decreased by pressing the single touch key, and is returned to the initial level when the key is pressed at the final level. In the latter case, the plurality of touch keys include an output increase key which is pressed to increase the heat output and an output decrease key which is pressed to decrease the heat output. The structure of output adjusting keys 9 is not limited to these examples.

The control modes may include, in addition to the above-mentioned manual heating mode, a temperature control mode in which the temperature of the object to be heated is controlled automatically to a predetermined temperature, a water heating mode in which water boiling is detected and the water is kept hot automatically, and a rice cooking mode in which rice is cooked automatically based on the amount of rice.

Touch key groups 5 are visually separated from heating coils 3 by partition part 11 arranged therebetween. To enhance the separation effect, belt-shaped partition part 11 is formed by printing a light-transmissive thin-film layer of black, brown, or other color different from the surrounding light non-transmissive print film of silver or other color provided on the rear surface of top plate 1. Partition part 11 includes number indicators 12, output indicators 13, and heating mode indicators 14 in addition to selection key indicator lamps 6 indicating the positions of heating mode selection keys 8. Each number indicator 12 displays the timer time when the timer function is selected in the manual heating mode or the preset temperature in the temperature control mode. Each output indicator 13 displays the amplitude of the heat output selected in the manual heating mode. Each heating mode indicator 14 displays one of the control modes in a predetermined order every time heating mode selection key 8 is pressed. Each selection key indicator lamp 6 is in the vicinity on the heating coil 3 side of heating mode selection key 8 and lights up as an index mark in the form of an inverted triangle in such a manner as to point heating mode selection key 8.

The specific operation of the induction cooker thus structured will be described as follows with reference to FIG. 3.

Figure 3:
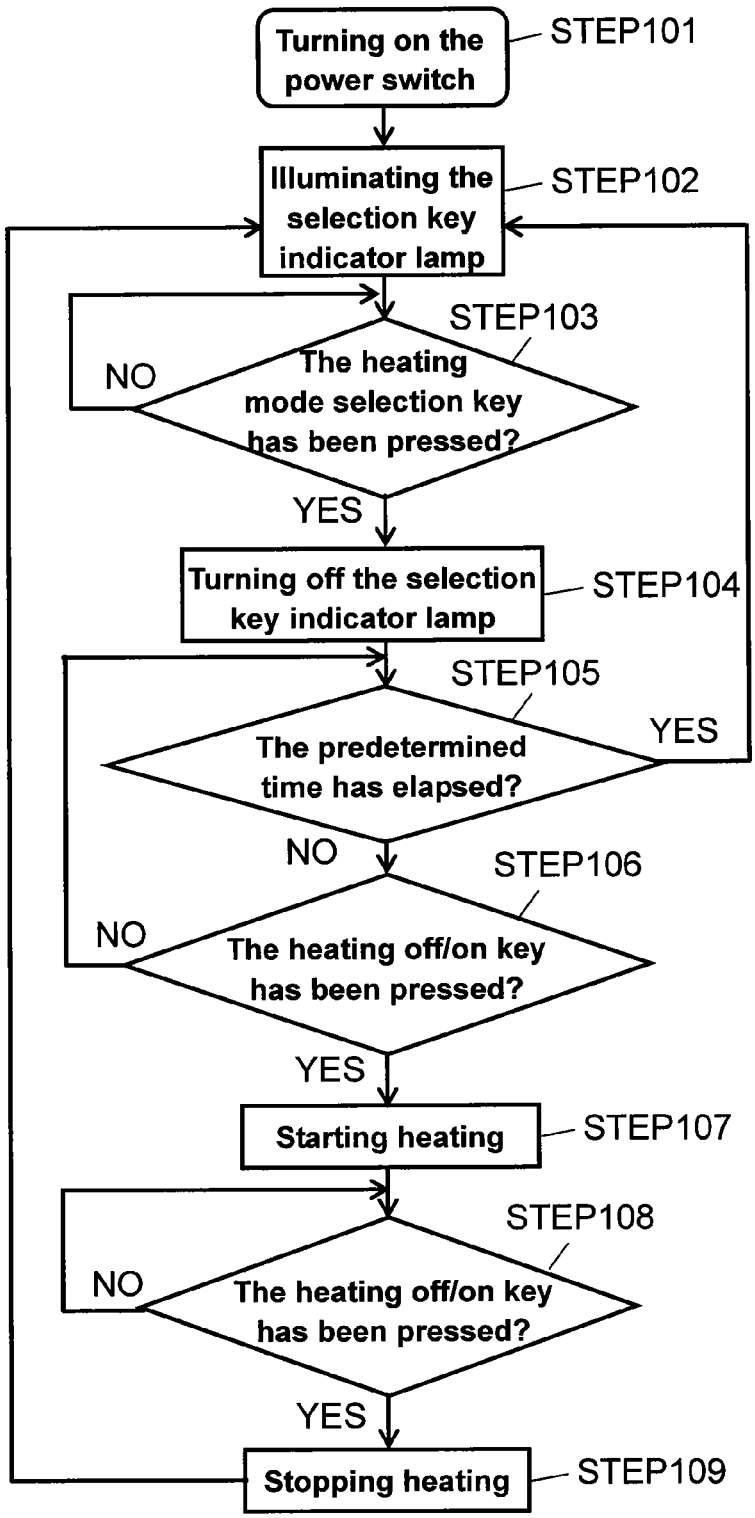
FIG. 3 shows the operation flow of the induction cooker according to the first exemplary embodiment of the present invention.

FIG. 3 shows the operation flow of touch key groups 5 and selection key indicator lamps 6. First of all, in STEP 101, the user turns on power switch 15. Upon detecting the ON state of power switch 15, controller 4 changes the mode to the standby mode in STEP 102. As a result, the LED of selection key indicator lamp 6 lights up, so that only the index mark in the form of the inverted triangle is illuminated in the vicinity on the heating coil 3 side of heating mode selection key 8. Number indicator 12, output indicator 13, and heating mode indicator 14 remain unlit.

In STEP 103, it is determined whether heating mode selection key 8 has been pressed. When heating mode selection key 8 has been pressed (YES), the mode is changed to a cooking menu selection mode in STEP 104 in which, for example, a manual heating mode is selected. In the cooking menu selection mode of STEP 104, every time heating mode selection key 8 is pressed, controller 4 changes the control mode to be selected in a predetermined order, for example, in the following order: the manual heating mode, the temperature control mode, the water heating mode, the rice cooking mode, and the standby mode. When the mode is changed to the cooking menu selection mode in STEP 104, selection key indicator lamp 6 goes out, and instead, heating mode indicator 14 lights up so that the user can recognize the selected control mode. When the mode is changed to the cooking menu selection mode in STEP 104, it is possible to flash one control mode selected by the user and to keep lighting up the remaining control modes that can be selected. It is also possible to return the mode to the standby mode of STEP 102 when the user has pressed all the control modes by repeatedly operating heating mode selection key 8 as described above.

When the mode is changed to the cooking menu selection mode in STEP 104, timer counting is started to count the time elapsed since heating mode selection key 8 was operated. In STEP 105, it is determined whether the time elapsed since heating mode selection key 8 was pressed and one of the control modes was selected has exceeded a predetermined time. In the case where heating mode selection key 8 is pressed again to change the control mode to be selected, for example, from the manual heating mode to the automatic temperature control mode, controller 4 may reset the counted elapsed time and restart the time counting. It is also possible to reset the counted elapsed time and to restart the time counting when the operating condition setting is changed by pressing an operating condition setting key in a predetermined control mode. An example of such situations is when the output setting is changed by pressing output adjusting key 9, which is an operating condition setting key in the manual heating mode. Another example is when the target temperature setting is changed by pressing output adjusting key (functioning also as a target temperature control key) 9, which is an operating condition setting key in the automatic temperature control mode. Further another example is when the timer time setting is changed by pressing timer key 10, which is an operating condition setting key in the manual heating mode. The operation of changing the selected control mode or changing the operating condition setting in the predetermined control mode indicates that the user wants to start heating. Therefore, the transition to the standby mode can be delayed until the predetermined time has elapsed since the setting was last changed. When the predetermined time has elapsed since heating mode selection key 8 was pressed last and the operation of selecting the control mode was completed (YES), the mode is changed to the standby mode in STEP 102. When the predetermined time has not elapsed (NO), on the other hand, the process goes to STEP 106 in which it is determined whether heating off/on key 7 has been pressed.

When heating off/on key 7 has been pressed (YES), the process goes to STEP 107 in which heating is started in the control mode selected by the user by pressing heating mode selection key 8. When heating off/on key 7 has not been pressed, on the other hand, the process goes back to STEP 105 in which it is determined whether the predetermined time has elapsed, and hence, whether the user still wants heating in the selected control mode. The predetermined time is preferably set to 10 seconds to 120 seconds, and more preferably about 60 seconds. When heating is started in STEP 107, the process goes to STEP 108 in which it is determined whether heating off/on key 7 has been pressed again. When heating off/on key 7 has been pressed again (YES), the process goes to STEP 109 in which heating is stopped so as to return to the standby mode of STEP 102. While selection key indicator lamp 6 is illuminating, other keys than heating mode selection key 8 are disabled in touch key group 5 corresponding to heating coil 3 in use.

Thus, when heating by heating coil 3 is stopped by operating heating off/on key 7 as the heating stop key, the mode is changed to the standby mode. To restart heating, the user is required to operate heating mode selection key 8 to change the mode to the cooking menu selection mode and to set the control mode, and then to operate heating off/on key 7 within the predetermined time. This structure prevents heating from occurring when the user presses heating off/on key 7 inadvertently and unintentionally while heating is not going on, such as after the user turns on power switch 15 or after the user stops heating by operating heating off/on key 7. As a result, the induction cooker provides a high degree of safety and increased user-friendliness.

It is also possible to make heating mode selection key 8 function as an unlock key instead of providing an unlock key as in the conventional cookers, thereby reducing the number of operation keys and simplifying the operation.

If a selected control mode has been changed in the cooking menu selection mode, controller 4 changes the mode to the standby mode when a predetermined time has elapsed since the control mode was last changed. The induction cooker includes the output adjusting keys (functioning also as target temperature control keys) 9 and timer keys 10, which are operating condition setting keys for setting the operating conditions in the control mode as described above. If an operating condition in the selected control mode is changed in the cooking menu selection mode, controller 4 changes the mode to the standby mode when a predetermined time has elapsed since the operating condition was last changed. The operation of changing a selected control mode or changing an operating condition setting in a predetermined control mode indicates that the user wants to start heating. Therefore, the transition to the standby mode can be delayed until the predetermined time has elapsed since the setting was last changed. The transition to the standby mode at such an unnecessarily early timing can be avoided to increase the user-friendliness of the induction cooker.

Controller 4 controls selection key indicator lamp 6 indicating the position of heating mode selection key 8 to light up in the standby mode and to go out when the standby mode is changed to the cooking menu selection mode. Thus, the lighting up of selection key indicator lamp 6 shows the user that the heating start key and other operation keys are enabled only when heating mode selection key 8 is operated and selection key indicator lamp 6 goes out. This helps the user to understand that heating can be started by first pressing heating mode selection key 8 to change the mode to the cooking menu selection mode for the purpose of unlocking heating off/on key 7 as the heating start key, and other operation keys. When the mode is changed to the cooking menu selection mode, selection key indicator lamp 6 goes out, showing the user how to select a control mode for starting heating or for performing other operations. Thus, the induction cooker guides the user to start heating in a selected control mode by pressing heating mode selection key 8 before operating the heating start key, thus providing smooth operability.

In the standby mode, controller 4 controls only selection key indicator lamp 6 to light up. This enables the user to recognize that selection key indicator lamp 6 is the first to be operated, thus guiding the user to press heating mode selection key 8 first when he/she wants to restart heating after it is once stopped. As a result, the induction cooker prevents the user from starting heating inadvertently and also provides smooth operation.

Each heating mode indicator 14 lights up in the form of a predetermined character or shape to indicate which control mode has been selected by the user by operating heating mode selection key 8. The selected control mode becomes less visible when heating mode indicator 14 goes out than when it is illuminating. In the cooking menu selection mode, controller 4 controls selection key indicator lamp 6 to go out and heating mode indicator 14 to light up. This structure helps the user to understand that the standby mode has been released, allowing the user to select a heating mode more easily.

Each selection key indicator lamp 6 lights up in the form of a predetermined character or shape to indicate the position of heating mode selection key 8. The predetermined character or shape becomes invisible or less visible when selection key indicator lamp 6 goes out than when it is illuminating. This structure helps the user to know whether the current mode allows the operation of heating mode selection key 8.

Heating mode selection keys 8, heating off/on keys (heating start keys, heating stop keys) 7, output adjusting keys 9, and timer keys 10 included in touch key groups 5 are separated from heating coils 3 by belt-shaped partition part 11 formed by printing a colored thin-film layer whose color is different from the surrounding print film provided on the front surface of top plate 1. In this separated arrangement, selection key indicator lamps 6 light up as index marks in the vicinity of heating mode selection keys 8 inside partition part 11.

With this structure, selection key indicator lamp 6 lights up to indicate the position of heating mode selection key 8, requiring the user to operate heating mode selection key 8. The index mark of selection key indicator lamp 6 becomes either invisible or less visible when selection key indicator lamp 6 goes out than when it is illuminating, preventing an erroneous operation by the user. Light-emitting parts such as selection key indicator lamps 6, number indicators 12, output indicators 13, and heating mode indicators 14 are grouped in partition part 11, and separated from touch key groups 5. This simple arrangement provides high operability and easy-to-follow display, making the induction cooker more user-friendly.

The operating part in the present exemplary embodiment consists of capacitive touch keys arranged on top plate 1 so as to provide high operability and high design. Alternatively, however, the operating part may consist of membrane touch keys arranged in a frame part on a side surface of top plate 1 by coating mechanical switches with a resin thin film.

The induction cooker according to the present exemplary embodiment includes power switch 15, and when power switch 15 is in the OFF state, the heating of object-to-be-heated 2 by heating coil 3 is disabled. When power switch 15 is turned on, controller 4 establishes the standby mode.

Thus, this structure provides safety by disabling the heating of object-to-be-heated 2 by heating coil 3 while power switch 15 is in the OFF state. Further safety is provided by making controller 4 start the heating of object-to-be-heated 2 by heating coil 3 only when power switch 15 is turned on to establish the standby mode and then both heating mode selection key 8 and heating off/on key 7 are operated. In other words, heating does not start when the user operates only heating off/on key 7 after power switch 15 is turned on, thus providing the induction cooker with a high degree of safety.

Power switch 15 has only to have a mark beside it indicating its presence and to be able to disable all functions of the induction cooker. More specifically, power switch 15 may be of a mechanical or relay type which disconnects a power line connected to the induction cooker. Alternatively, power switch 15 may include an electric circuit that functions as a general power switch by processing a control signal instead of disconnecting the power line.

Figure 4:
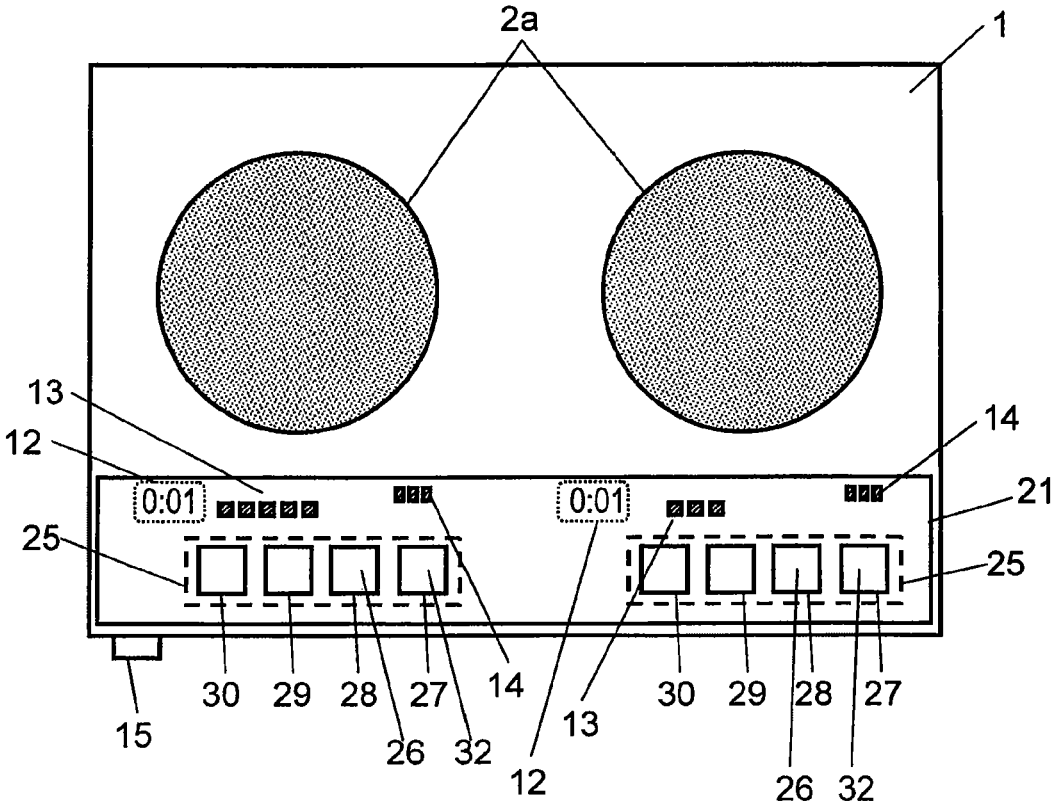
FIG. 4 is an external plan view of the top of a top plate of a modified example of the induction cooker according to the first exemplary embodiment of the present invention.

Touch key groups 5 including heating mode selection keys 8 are provided outside partition part 11 as shown in FIG. 2 in the present exemplary embodiment, but they may be provided inside partition part 11 as shown in FIG. 4. FIG. 4 is an external plan view of the top of a top plate of a modified example of the induction cooker according to the first exemplary embodiment. In FIG. 4, like components are labeled with like reference numerals with respect to FIG. 2.

As shown in FIG. 4, it is possible to provide touch key groups 25 corresponding to touch key groups 5 of FIG. 2 in partition part 21, which is formed in the same manner as partition part 11 of FIG. 2, but is formed larger than it. In this case, selection key indicator lamps 26 corresponding to selection key indicator lamps 6 of FIG. 2 can be included in heating mode selection keys 28 corresponding to heating mode selection keys 8 of FIG. 2. Selection key indicator lamps 26 are illuminated by LEDs or other light emitters from the rear surface so as to light up in the form of a predetermined character or symbol. The predetermined character or symbol is formed by cutting out the electrodes forming the touch keys. The predetermined character or symbol can become invisible by turning off selection key indicator lamp 26. In addition, heating off/on keys 27, output adjusting keys 29, and timer keys 30 may have the same structure as selection key indicator lamps 26, allowing touch keys necessary for operation to light up and unnecessary touch keys to go off, thereby providing a simple operation.

In the induction cooker of FIG. 4, each heating off/on key 27 as the heating start key includes heating start key indicator 32, which lights up in the form of a predetermined character or shape to indicate the position of heating off/on key 27. The predetermined character or shape becomes invisible or less visible when heating start key indicator 32 goes out than when it is illuminating. In addition, in the standby mode, controller 4 controls heating start key indicator 32 to go out. As a result, in the standby mode, controller 4 does not start heating even if the user presses heating off/on key 27, and in addition to this, heating start key indicator 32 goes out to become invisible or almost invisible, thus preventing the user from operating inadvertently, and hence, providing a simple operation and increased operability.

Figure 5:
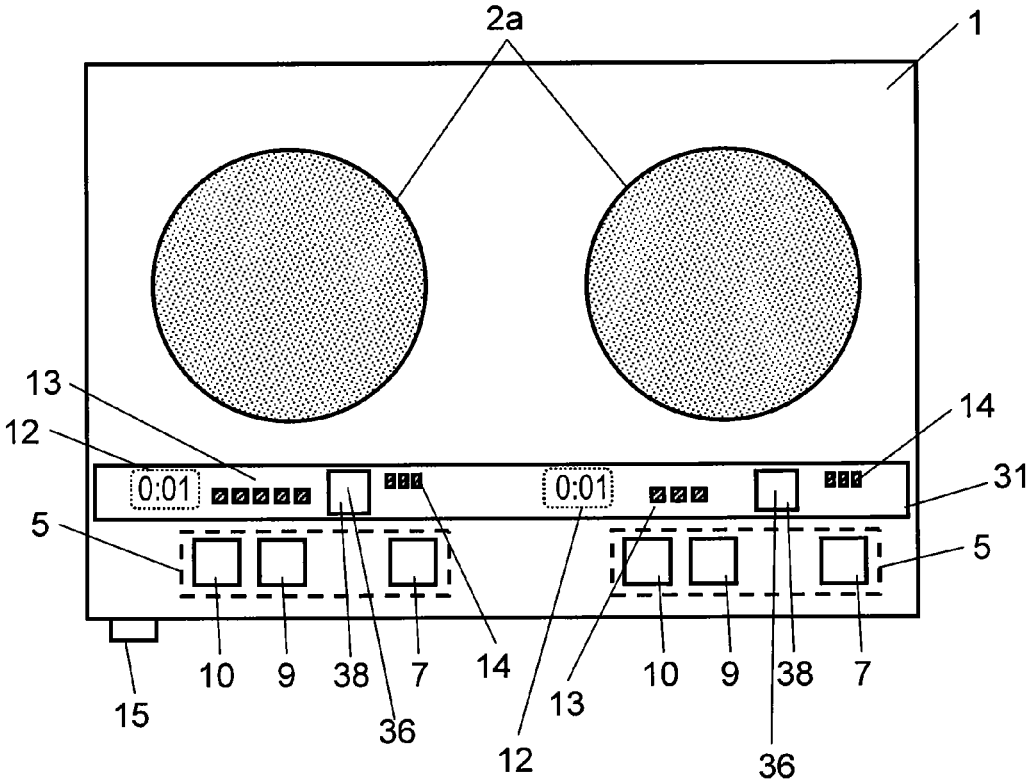
FIG. 5 is an external plan view of the top of a top plate of another modified example of the induction cooker according to the first exemplary embodiment of the present invention.

FIG. 5 is an external plan view of the top of a top plate of another modified example of the induction cooker according to the first exemplary embodiment. As shown in FIG. 5, it is possible to provide heating mode selection keys 38 in partition part 31, which is formed in the same manner as partition part 11 of FIG. 2. In this case, it is possible to arrange selection key indicator lamps 36, which correspond to selection key indicator lamps 6 of FIG. 2 in the same manner as selection key indicator lamps 26 of FIG. 4. More specifically, each selection key indicator lamp 36 is included in heating mode selection key 38 and illuminated from the rear surface so as to light up as an index mark in the form of a predetermined character or symbol. The predetermined character or symbol becomes invisible when selection key indicator lamp 36 goes out. In FIG. 5, like components are labeled with like reference numerals with respect to FIG. 2.

Two heating coils 3 are used in the present exemplary embodiment, but one, three, or more heating coils 3 may be used.

INDUSTRIAL APPLICABILITY

The induction cooker according to the present invention can prevent heating from occurring when the user inadvertently presses the heating start key for some reason, thus providing a high degree of safety and increased user-friendliness. Therefore, the induction cooker is useful as a domestic or industrial induction cooker having touch keys.

The invention claimed is:

1. An induction cooker comprising:

a heating coil for induction-heating an object to be heated;

a top plate for placing the object thereon, the top plate being placed above the heating coil;

a controller for controlling a heat output of the heating coil;

a heating mode selection key for allowing a user to select one control mode for heating the object between a manual heating mode in which the heat output is set by the user by using an output adjusting key and at least another control mode in which the heat output is controlled automatically without a need for the user to press any temperature control key; and a heating start key for starting to heat the object to be heated, wherein in a standby mode, the controller controls the heating coil to start heating the object only when the heating start key is operated after the heating mode selection key is operated to select one of the control modes, and when the heating mode selection key is operated in the standby mode, the mode is changed to a cooking menu selection mode, and when a predetermined time has elapsed in the cooking menu selection mode without a change in a selected control mode, the mode is changed to the standby mode.

2. The induction cooker of claim 1, wherein, when the selected control mode is changed in the cooking menu selection mode, the controller changes the mode to the standby mode when a predetermined time has elapsed since the control mode was last changed.

3. The induction cooker of claim 2, further comprising:

an operating condition setting key for setting an operating condition of a control mode, wherein when the operating condition of the selected control mode is changed in the cooking menu selection mode, the controller changes the mode to the standby mode when a predetermined time has elapsed since the operating condition was last changed.

4. The induction cooker of claim 1, further comprising:

an operating condition setting key for setting an operating condition of a control mode, wherein when the operating condition of the selected control mode is changed in the cooking menu selection mode, the controller changes the mode to the standby mode when a predetermined time has elapsed since the operating condition was last changed.

5. The induction cooker of claim 1, further comprising:

a heating stop key for stopping heating the object, wherein when the heating of the object by the heating coil is stopped by operating the heating stop key, the mode is changed to the standby mode.

6. The induction cooker of claim 5, wherein the controller controls a selection key indicator lamp indicating a position of the heating mode selection key to light up in the standby mode, and to go out when the standby mode is changed to the cooking menu selection mode.

7. The induction cooker of claim 1, wherein the controller controls a selection key indicator lamp indicating a position of the heating mode selection key to light up in the standby mode, and to go out when the standby mode is changed to the cooking menu selection mode.

8. The induction cooker of claim 7, wherein in the standby mode, the controller controls only the selection key indicator lamp to light up.

9. The induction cooker of claim 8, further comprising:

a heating mode indicator lighting up to indicate the control mode selected by the user by operating the heating mode selection key, and going out to make the control mode less visible than when the heating mode indicator is illuminating, wherein, in the cooking menu selection mode, the controller controls the selection key indicator lamp to go out, and the heating mode indicator to light up.

10. The induction cooker of claim 7, wherein the selection key indicator lamp indicates the position of the heating mode selection key by lighting up in a form of a predetermined character or shape, the predetermined character or shape becoming invisible or less visible when the selection key indicator lamp goes out than when the selection key indicator lamp is illuminating.

11. The induction cooker of claim 10, further comprising:

a heating mode indicator lighting up in a predetermined character or shape to indicate the control mode selected by the user by operating the heating mode selection key, and going out to make the predetermined character or shape indicating the control mode less visible than when the heating mode indicator is illuminating, wherein the heating mode selection key, the heating start key, and the output adjusting key are separated from the heating coil by a belt-shaped partition part formed by printing a light-transmissive thin-film layer having a color different from a surrounding print film provided on one of a rear surface and a front surface of the top plate;

in the standby mode, the controller controls the selection key indicator lamp to light up as an index mark in a vicinity of the heating mode selection key inside the partition part, and the heating mode indicator to go out; and when the mode is changed to the cooking menu selection mode, the controller controls the heating mode indicator to light up in the partition part.

12. The induction cooker of claim 7, wherein the heating start key includes a heating start key indicator to indicate a position of the heating start key by lighting up in a form of a predetermined character or shape, the predetermined character or shape becoming invisible or less visible when the heating start key indicator goes out than when the heating start key indicator is illuminating, and in the standby mode, the controller controls the heating start key indicator to go out.

13. The induction cooker of claim 1, further comprising:

a power switch, wherein when the power switch is in an OFF state, the heating of the object to be heated by the heating coil is disabled, and when the power switch is turned on, the standby mode is established.

14. The induction cooker of claim 1, wherein the at least another control mode comprises one or more of a temperature control mode in which the temperature of the object is controlled automatically to a predetermined temperature, a water heating mode in which water boiling is detected and the water is kept hot automatically, and a rice cooking mode in which rice is cooked automatically based on an amount of rice.

* * * * *